US005964317A

United States Patent [19]

Lattavo

[11] Patent Number: 5,964,317

[45] Date of Patent: Oct. 12, 1999

[54] PORTABLE LADDER FOR TRUCK TRAILERS

[76] Inventor: Philip E. Lattavo, 5555 East Blvd. NW., Canton, Ohio 44718

[21] Appl. No.: 09/153,618

[22] Filed: Sep. 15, 1998

[51] Int. Cl.[6] ..... E06C 5/00

[52] U.S. Cl. ..... 182/127; 280/163

[58] Field of Search ..... 182/90, 92, 93, 182/100, 127; 280/163, 165, 166

[56] References Cited

U.S. PATENT DOCUMENTS

| | | | |
|---|---|---|---|
| 3,033,309 | 5/1962 | Fugere | 182/90 |
| 3,869,742 | 3/1975 | Gale et al. | 182/189 |
| 5,024,292 | 6/1991 | Gilbreath et al. | 182/90 |
| 5,046,582 | 9/1991 | Albrecht | 182/127 |
| 5,163,531 | 11/1992 | Whiting | 182/127 X |
| 5,687,813 | 11/1997 | Bensch | 182/127 |

*Primary Examiner*—Daniel P. Stodola
*Assistant Examiner*—Hugh B. Thompson
*Attorney, Agent, or Firm*—Sand & Sebolt

[57] ABSTRACT

A portable ladder for truck trailers including a post, a hand grip attached to the post, at least a first step connected to the post, and a stake connected to the post is adapted to be used in conjunction with a flat-bed trailer having a body and a protective rail. The stake is adapted to removably and slidably mount in the space between the body and the protective rail with the stake being inserted into the space until a support plate rests flush against the top of the trailer body. The steps extend outwardly and alternately from opposite sides of the staff. The stake forms an angle with the post such that when the stake is installed in the space between the body and the rail of the flat-bed truck, the lower end of the staff extends downward and outwardly from the truck so that a person can easily climb up the ladder onto the trailer while having a hand grip to hold onto.

18 Claims, 3 Drawing Sheets

PORTABLE LADDER FOR TRUCK TRAILERS

BACKGROUND OF THE INVENTION

Technical Field

This invention relates generally to ladders. More particularly, the present invention relates to a portable ladder that may be used with a truck trailer. Specifically, the present invention relates to a portable ladder having a centrally-disposed post with steps extending from either side of the post, the ladder being adapted to removable mount in the space between the protective rail and body of a flat-bed trailer.

Background Information

Commercial truckers frequently encounter situations in which they require personal access to the elevated flat-bed cargo carrier pulled by the tractor. The cargo carrier may be mounted on the truck frame itself, as in the case of a bob-tail truck, or the cargo carrier may be mounted to a trailer pulled by a truck tractor. In either case, the conventional truck cargo carrier includes an elongated substantially horizontal cargo bed elevated about four to five feet above ground level.

After cargo has been loaded onto the flat-bed cargo carrier or flat-bed trailer, the cargo typically must be secured by chains, tie-down straps, or other similar devices. If the cargo is not secured to the trailer, the cargo is likely to fall off the trailer during transport. This situation is desirably avoided for obvious reasons. The securing devices may also have to be periodically adjusted during transport because of load shifts or temperature changes. When the cargo reaches its destination, the chains, tie-down straps, etc. must be removed before the cargo can be unloaded from the trailer. The placement, periodic adjustment, and removal of such chains and/ortie-down straps often requires the truck driver to climb up on the elevated trailer bed to perform the task, and thereafter requires that the truck driver climb down from the elevated bed to the ground.

The greatest likelihood of injury to a truck driver occurs during ascent to and descent from the elevated bed of a trailer. These injuries often occur because most truck drivers hoist themselves up to the elevated bed by hand and get down from the elevated trailer by jumping to the ground. Such practices often result in bodily injuries such as broken bones, pulled muscles, sprained ankles, as well as cuts, scrapes, bruises and other such injuries.

The securing of cargo to the elevated bed of a trailer is but one of the reasons for which a truck driver may be required to ascend to the elevated trailer bed. Truck drivers may be required to ascend to the trailer bed to perform an inventory of the cargo, to check the condition of the cargo, to check the condition of the trailer, and for other numerous reasons. Thus, a device that can facilitate the safe ascent and descent of the truck driver to and from the elevated bed of a trailer is desired in the art.

Such a device must be lightweight yet be strong enough to support the weight of a truck driver. The device must also be suited to withstand the abusive environment of commercial cargo hauling where the device will be subject to repeated use at various temperatures and will be subject to heat, rain, snow, road salt, and other corrosive materials. Moreover, to encourage use of such a device, the device should be preferably easily removable from the storage position on a trailer and installed for use. The device should also be able to be remounted back on the trailer or on a different trailer in a matter of seconds. If the transfer of the device from one trailer to another requires more than a few seconds or requires any type of manipulation of tools by the truck driver, the truck driver may elect not to install a ladder on the trailer and simply climb up on the trailer bed by hand and descend therefrom by jumping, resulting in the risk of injury described above. Such a device also preferably would be securable against loss due to theft and/or the device falling from the truck while the truck is in transit.

A number of devices have attempted to meet the needs of truck drivers and the truck driving industry in this regard. While such devices have been effective for their intended uses, such devices have not been without imitation and room in the art remains for improvement.

For instance, U.S. Pat. No. 5,024,292 to Gilbreath et al. discloses a portable ladder assembly for truck trailers in which a semi-collapsible ladder is mounted between the rail and the body of a flat-bed truck trailer. The ladder disclosed in the patent is clamped with threaded fasteners between the body and rail of a truck trailer, and can be removed from the truck trailer only with the aid of hand tools. Thus, the portable ladder system disclosed in the Gilbreath reference requires a significant effort on the part of the truck driver to remove the ladder for use with another trailer.

It is thus desired to provide a ladder that will facilitate the ascent to and descent from the elevated bed of a flat-bed trailer, with the device being readily installed onto and removed from a trailer, usable with multiple trailers, and is strong, lightweight, and easy to handle by a truck driver.

SUMMARY OF THE INVENTION

In view of the foregoing, an objective of the invention is to provide a device that facilitates the ascent to and descent from a truck trailer.

An additional objective of the invention includes providing a device having at least one step to facilitate ascent to and descent from a truck trailer.

Another objective of the invention includes providing a device having a hand grip for facilitating the safe ascent to and descent from the bed of a truck trailer.

Another objective of the invention includes providing a device that is lightweight yet strong enough to support the weight of a truck driver.

Another objective of the invention includes providing a device that mounts between the body and the protective rail of the bed of a flat-bed trailer.

Another objective of the invention includes providing a device that rests against the bed of a flat-bed trailer to provide stability.

Another objective of the invention includes providing a device that can be easily removed from one trailer and quickly reinstalled on a different trailer.

Another objective of the invention includes providing a device that can be easily carried and stowed after use.

Another objective of the invention includes providing a device that can be easily locked to the trailer to prevent theft of the device.

These and other objectives and advantages of the invention are obtained by the portable ladder of the present invention, the general nature of which can be stated as including a post; at least a first step connected to said post; and a stake connected to said post, said stake adapted to be removably and slidably mounted in a space between a protective rail and a trailer body of a flat-bed trailer.

Other objectives and advantages of the invention are obtained by the combination of a portable ladder and a flat-bed trailer, the general nature of which may be stated as including a flat-bed trailer having a substantially flat trailer body and a protective rail spaced from the trailer body to form a space; the portable ladder including a central post, at least one step extending from the post, a stake extending down from the post, the stake slidably and removably disposed in the space between the protective rail and the trailer body with the post extending down from the protective rail.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended claims.

Similar numbers refer to similar elements throughout the specification.

DESCRIPTION OF THE PREFERRED EMBODIMENT

Figure 1:
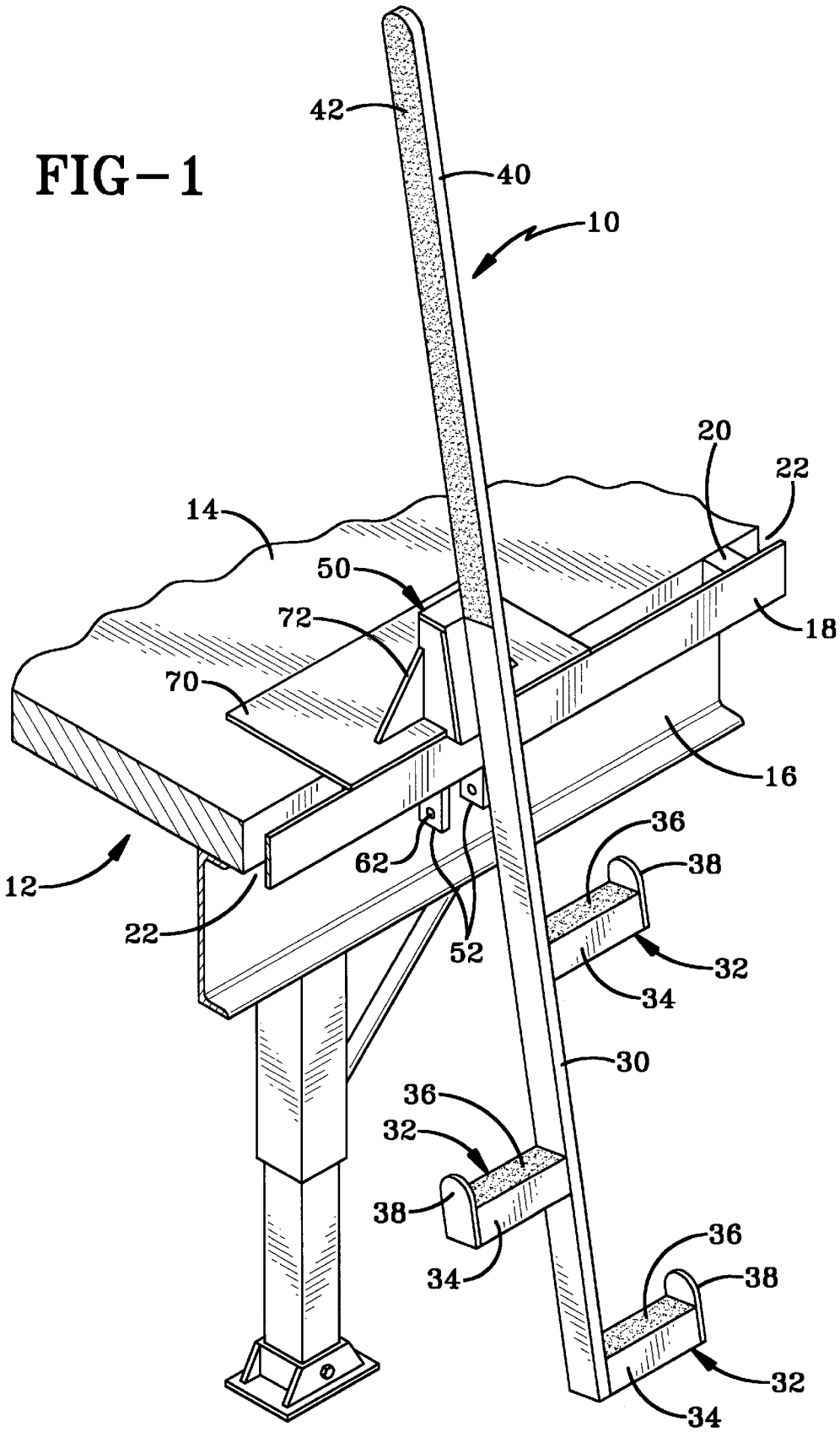
FIG. 1 is a perspective view of the portable ladder of the present invention used in combination with a flat-bed trailer cargo carrier.

The portable ladder for truck trailers made in accordance with the concepts of the present invention is depicted in the drawings and is indicated generally by the numeral 10. The portable ladder 10 is designed to be used with a flat-bed trailer 12, a portion of which is depicted in the figures. In general, flat bed trailer 12 includes a substantially flat trailer body 14 that is supported on a support structure such as the rails 16 depicted in the drawings. Most flat-bed trailers 12 include a protective rail 18 that substantially surrounds trailer body 14 and is spaced therefrom by a plurality of spacers 20. Spacers 20 space protective rail from trailer body 14 in order to protect the edge of trailer body 14 and to provide a location where security devices may be connected to trailer 12. Protective rail 18 is typically fabricated from a metal and supports spacers 20 are also fabricated from a material and in a manner that results in protective rail 18 being sufficiently strong to support the relatively large amount of weight. Portable ladder 10 is adapted to quickly and easily be installed on trailer 12 by removably sliding portable ladder into space 22 between protective rail 18 and trailer body 14. Ladder 10 allows a person to easily and safely gain access to trailer body 14 from the ground level.

Portable ladder 10 includes a central post 30 that supports a plurality of steps 32 that extend outwardly and alternatively from post 30. Each step 32 is substantially perpendicular to post 30. Each step 32 includes a step base 34 having a top surface that is preferably covered with a gripping material 36 to provide traction to ladder 10. Each step 32 further includes a safety flange 38 that is connected to the outer end of each step 32. Each safety flange 38 extends above gripping material 36 to prevent a person's foot from sliding outwardly off of steps 32.

In the preferred embodiment of the present invention, ladder 10 includes three steps 32. Two of steps 32 extend from the right side of ladder 10 with the intermediate step 32 extending from the left side of post 30. The intermediate step is disposed at substantially equal distance between the other two steps 32 such that steps 32 are alternatively disposed on post 30. This arrangement allows a person using ladder 10 to naturally climb the ladder by placing the right foot on the lower most step 32 and then placing the left foot on the next highest step 32 that is disposed on the left side of post 30 and then following with the right foot being placed on the upper most step 32 that is on the right side of post 30. The person then would place the left foot on trailer body 14.

A hand grip 40 is provided to give the user of ladder 10 a handhold while climbing onto and off of ladder 10. Hand grip 40 is integrally formed with post 30 and is an extension of post 30 in the preferred embodiment of the present invention. In other embodiments of the present invention, hand grip 40 may be attached to post 30 at a variety of angles and by any of the connecting elements known in the art. For instance, hand grip 40 may be bolted to post 30 so that hand grip 40 may be selectively removable from post 30 such as when ladder 10 is being shipped in a box. Hand grip 40 may also extend at a different angle that the zero degree angle depicted in the drawings. Hand grip 40 may also include handholds in the nature of extending posts or the like that would assist a person using ladder 10 in climbing onto and off of trailer 12. Hand grip 40 is also covered with a gripping material 42 to provide traction to the person using ladder 10.

Ladder 10 further includes a stake 50 that extends downwardly from post 30. Stake 50 is configured and adapted to be slidably and removably received in space 22 between protective rail 18 and trailer body 14. Although stake 50 may be connected to post 30 by any of the variety of connectors known in the art, stake 50 is welded to post 30 in the preferred embodiment of the present invention. Stake 50 includes a pair of lugs 52 that are spaced, substantially parallel, and substantially vertical with respect to trailer 12. Lugs 52 each have an upper portion 54 that are connected by an upper plate 56 and a front plate 58. Post 30 is welded to front plate 58 in a manner that provides a strong and permanent connection between post 30 and stake 50.

Each lug 52 has a width indicated by the dimension line labeled by numeral 60 that is slightly less than the standard width of space 22 in a standard trailer 12. Width 60 causes lugs 52 to slidably engage protective rail 18 and trailer body 14 when ladder 10 is installed and received on trailer 12. Width 60 of lugs 52 also helps to prevent ladder 10 from twisting with respect to trailer 12 when ladder 10 is installed. The use of two spaced lugs 52 also helps to prevent ladder 10 from becoming unstable.

Each lug 52 has a hole 62 disposed at its lower end. Holes 62 are aligned with one another so that a pin (not shown) may be passed through each lug 52 to secure ladder 10 in a storage location, to lock ladder 10 in the storage or installed position, or to provide a safety mechanism to ladder 10 when ladder 10 is in the installed position.

Although lugs 52 of ladder 10 provide a stable connection between trailer 12 and ladder 10, the nature of ladder 10 demands that it be as stable and safe as possible so that accidents do not occur during use of ladder 10. To this end, a stabilizing plate 70 is connected to post 30. Stabilizing plate 70 is a substantially flat plate that is substantially horizontal with respect to trailer 12 and rests on the top surface of trailer body 14 and protective rail 18 when ladder is installed. Stabilizing plate 70 thus helps transfer the weight of ladder 10 and is the user of ladder 10 to trailer 12 and helps stabilize ladder 10 with respect to trailer 12. In the preferred embodiment of the present invention, stabilizing plate 70 is substantially perpendicular to stake 50 and is connected to stake 50 by appropriate connectors such as welds. A pair of flanges 72 extend between upper portions 54 of lugs 52 and stabilizing plate 70 to provide additional support and structure to ladder 10. Flanges 72, upper portions 54, upper plate 56 and front plate 58 are all welded together and function as a brace that provides a stable and secure support between post 30 and trailer body 14.

Figure 2:
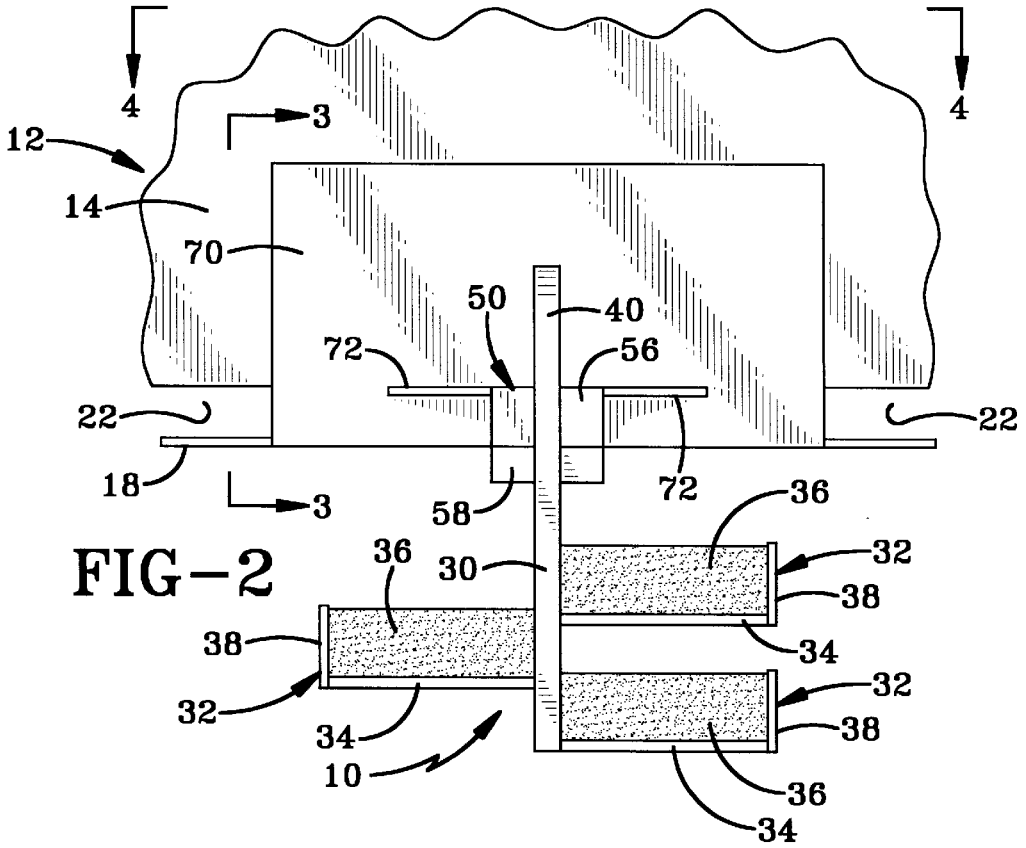
FIG. 2 is a top view of the combination depicted in FIG. 1.
Figure 3:
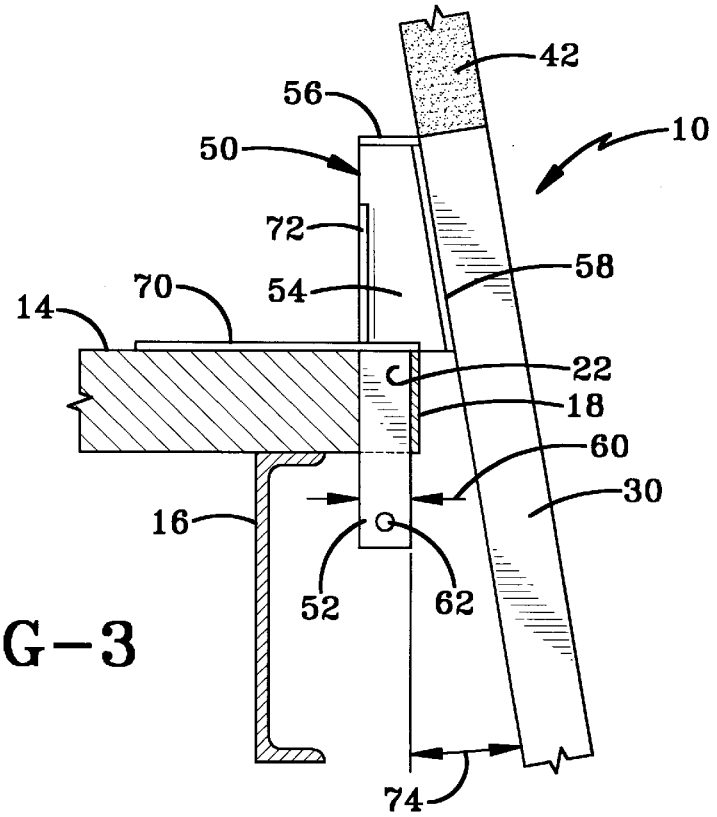
FIG. 3 is a sectional side view taken along line 3—3 of FIG. 2.
Figure 4:
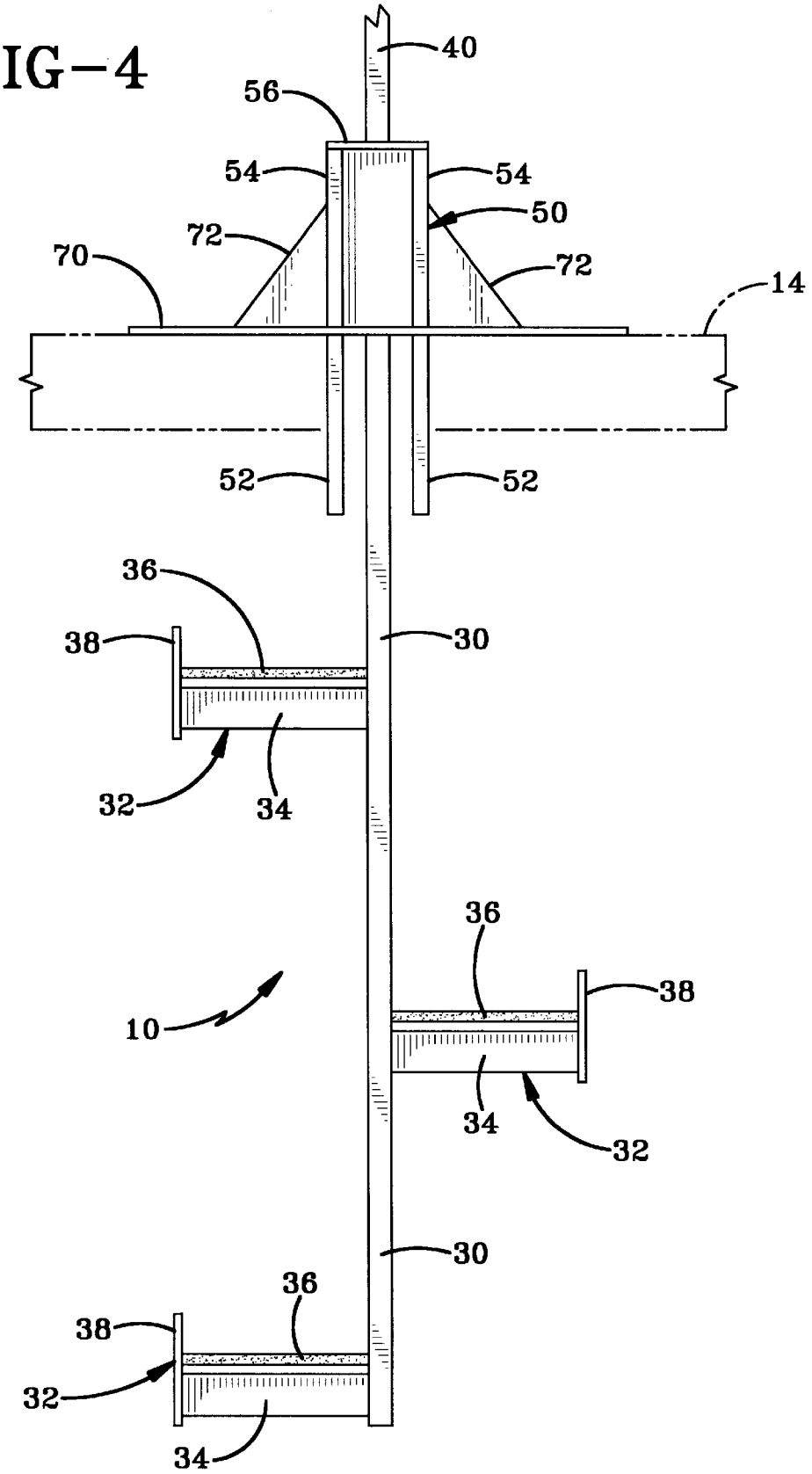
FIG. 4 is a rear elevational view of the ladder of the present invention taken along line 4—4 of FIG. 2 with the rail removed for clarity and the trailer body depicted in dashed lines so that the entire rear elevational view of the ladder may be seen.

As may be perhaps best seen in FIG. 3 post 30 is disposed at an angle with respect to vertical as is indicated by the dimension line labeled with the numeral 74. The angular disposition of post 30 allows ladder 10 to be more easily by the user as depicted in FIG. 2. The angular disposition allows steps 32 to be used more easily than when post 30 is disposed substantially vertically. Angle 74 is preferably in an approximate range of zero degrees and twenty degrees. This range of angles allows ladder 10 to be easily used while not causing ladder 10 to extend out from trailer 12 an undesirable distance. Of course, the invention contemplates that other angles 74 may be used of perhaps up to 75 degrees is such an angle is desired. For instance, ladder 10 may function more like a ramp when angle 74 is sufficiently large and the lower end of post 30 engages the ground. However, ladder 10 is preferably fabricated and used such that post 30 is disposed at a seven degree angle 74 with respect to stake 50.

Accordingly, the improved portable ladder for truck trailers apparatus is simplified, provides an effective, safe, inexpensive, and efficient device that achieves all the enumerated objectives of the invention, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the portable ladder for truck tailers is constructed and used, the characteristics of the construction, and the advantageous new and useful results obtained; the new and useful structures, devices, elements, arrangements, parts, and combinations are set forth in the appended claims.

I claim:

1. A portable ladder adapted to be used with a flat-bed trailer, the trailer having a trailer body with a protective rail spaced from the body, said portable ladder comprising:

a post, said post having a longitudinal axis;

at least a first step connected to said post;

a stake connected to said post, said stake adapted to be removably and slidably mounted in the space between the protective rail and the trailer body;

said stake having at least one lug having a longitudinal axis with the longitudinal axis of the lug and the longitudinal axis of the post forming an angle of between substantially 0 degrees and substantially 75 degrees; and a stabilizing plate connected to one of said stake and said post; said stabilizing plate being disposed substantially perpendicular to said longitudinal axis of the said stake and stabilizing plate adapted to engage and rest on the body of the trailer.

2. The portable ladder as set forth in claim 1, further comprising at least a second step, said second step extending from said post on an opposite side than said first step.

3. The portable ladder as set forth in claim 2, further comprising a handgrip disposed above said post.

4. The portable ladder as set forth in claim 3 wherein said handgrip is formed integrally with said post.

5. The portable ladder as set forth in claim 4, wherein said stake includes a pair of lugs; said lugs being spaced apart.

6. The portable ladder as set forth in claim 5, wherein said lugs are substantially perpendicular to said stabilizing plate.

7. The portable ladder as set forth in claim 6, wherein said longitudinal axis of each lug forms an angle with said longitudinal axis of said post of between substantially 5 and substantially 20 degrees.

8. The portable ladder as set forth in claim 7, wherein said handgrip is an extension of the said post and is substantially parallel with said longitudinal axis of said post.

9. The portable ladder as set forth in claim 8 further comprising a safety flange connected to each of said steps.

10. The portable ladder as set forth in claim 9 further comprising a brace assembly disposed between said stabilizing plate, said stake, and said post.

11. The portable ladder as set forth in claim 10, further comprising at least a third step, said steps extending outwardly and alternately from said post.

12. The portable ladder as set forth in claim 11 wherein each said lugs is formed with a hole therein.

13. The portable ladder as set forth in claim 12, wherein said longitudinal axis of each lug forms an angle with said longitudinal axis of said post of substantially 7 degrees.

14. The portable ladder as set forth in claim 13, further comprising hand grip that extends upwardly from said post above said stabilizing plate.

15. In combination, a portable ladder and a flat-bed trailer, the flat-bed trailer having a substantially flat trailer body and a protective rail spaced from said trailer body to form a space; said portable ladder including a central post having a longitudinal axis, at least one step extending from said post, and a stake extending down from said post, said stake, having at least one lug having a longitudinal axis with the longitudinal axis of the lug and the longitudinal axis of the post forming an angle of between substantially 0 degrees and substantially 75 degrees; said lug selectively slidably and removably disposed in said space between said protective rail and said trailer body with said post extending down from said protective rail; said protective rail disposed between said post and said lug; said ladder supported by said protective rail; whereby the portable ladder may be selectively installed on the trailer by sliding the lug between the protective rail and trailer body and may be removed by lifting the ladder so that the lug slides out from between the protective rail and the trailer body.

16. The combination as set forth in claim 15, further comprising a stabilizing plate connect to one of said post and said stake, said stabilizing plate resting on at least said trailer body.

17. The combination as set forth in claim 16, wherein said lug is substantially perpendicular to said stabilizing plate; said post extending above said stabilizing plate to form a hand grip.

18. In combination, a portable ladder and a flat-bed trailer, the flat-bed trailer having a substantially flat trailer body and a protective rail spaced from said trailer body to form a space;

said portable ladder including a central post, at least one step extending from said post, a stake connected to said post, and a stabilizing plate connected to said stake;

said stake having a least one lug;

said post having a longitudinal axis and said lug having a longitudinal axis;

said longitudinal axis of said post forming an angle with said longitudinal axis of said lug of between substantially five degrees and twenty degrees;

said stabilizing plate being substantially perpendicular to said longitudinal axis of said lug; and said stake selectively slidably and removably disposed in said space between said protective rail and said trailer body with said post extending down from said protective rail with said stabilizing plate resting on at least said trailer body whereby the portable ladder may be selectively installed on the trailer by sliding the stake between the protective rail and the trailer body and may be selectively removed from the trailer by lifting the portable ladder so that the stake slides out from between the protective rail and the trailer body.

* * * * *